US006446312B1

(12) United States Patent
Kabat

(10) Patent No.: US 6,446,312 B1
(45) Date of Patent: Sep. 10, 2002

(54) BUTTONING ACCESSORY

(76) Inventor: Thomas W. Kabat, 4165 Manke Rd., Fairgrove, MI (US) 48733

( * ) Notice: Subject to any disclaimer, the term of this patent is extended or adjusted under 35 U.S.C. 154(b) by 0 days.

(21) Appl. No.: 09/442,708

(22) Filed: Nov. 18, 1999

(51) Int. Cl.[7] ..... A41F 1/02; A47G 25/92
(52) U.S. Cl. ..... 24/40
(58) Field of Search ..... 24/40, 41, 45, 24/429; 7/123, 169; 294/3.6, 33

(56) References Cited

U.S. PATENT DOCUMENTS

| | | | | | |
|---|---|---|---|---|---|
| 68,361 | A | * | 9/1867 | Goldthwait | 24/40 |
| RE6,523 | E | * | 6/1875 | Stackpole | 24/40 |
| 208,858 | A | * | 10/1878 | Smith | 24/40 |
| 215,612 | A | * | 5/1879 | Howland | 24/40 |
| ,240,632 | A | | 4/1881 | Adamson | |
| 240,632 | A | * | 4/1881 | Adamson | 24/40 |
| 322,284 | A | * | 7/1885 | Havell | 24/40 |
| 339,055 | A | * | 3/1886 | Henderson | 24/40 |
| 438,044 | A | * | 10/1890 | Williams | 24/40 |
| 579,262 | A | * | 3/1897 | Esterly | 24/40 |
| ,615,482 | A | | 12/1898 | Gans | |
| D31,433 | S | | 8/1899 | Clarkson | |
| ,639,442 | A | | 12/1899 | Salisbury | |
| 639,442 | A | * | 12/1899 | Salisbury | 24/40 |
| 976,098 | A | * | 11/1910 | Robinson | 24/40 |
| 1,073,815 | A | * | 9/1913 | Newlon | 24/40 |
| 1,084,399 | A | * | 1/1914 | Collins | 24/40 |
| D49,166 | S | * | 6/1916 | Vaughan | 24/40 |
| 1,463,400 | A | | 7/1923 | Neumann | |
| 1,469,437 | A | | 10/1923 | Fredrickson | |
| 1,710,020 | A | | 4/1929 | Gifford | |
| 4,942,646 | A | | 7/1990 | Sebastian | |
| 5,347,688 | A | * | 9/1994 | Ross | 24/40 |
| D401,389 | S | | 11/1998 | Taylor | |

* cited by examiner

*Primary Examiner*—Anthony Knight
*Assistant Examiner*—Ruth C. Rodriguez
(74) *Attorney, Agent, or Firm*—Reising, Ethington, Barnes, Kisselle, Learman & McCulloch, P.C.

(57) ABSTRACT

A buttoning accessory for facilitating one-hand passage of a button through a buttonhole has a flexible handle to one end of which is secured a flat retainer having two substantially right-angular limbs each of which has a slot therein. The angular relationship of the limbs forms an elbow having an inside edge and an outside edge. Both the handle and the retainer are of such width and thickness as to pass freely through the buttonhole. Movement of the accessory through the buttonhole causes a button accommodated in the slot of the retainer also to pass through the buttonhole.

15 Claims, 1 Drawing Sheet

BUTTONING ACCESSORY

This invention relates to an accessory especially adapted for use by handicapped persons in effecting buttoning of one part of a garment to another.

BACKGROUND OF THE INVENTION

There are many persons who for one reason or another are unable to use two hands in passing a button through a buttonhole in such manner as to secure together the overlapping edges of two parts of a garment. The problems associated with one-handed buttoning have been recognized before, but the solutions proposed have been less than satisfactory.

One-handed buttoning difficulties are especially prevalent when it is desired to button the overlapping ends of a waistband of a pair of jeans or the like which are formed from soft, pliable textile material. This is because the material to which the waistband is sewn or otherwise attached is unable to support the ends of the waistband in a position in which one end of the waistband overlies the companion end and supports the button in a position to pass through a buttonhole. The person attempting to button together the overlying ends of the waistband thus is confronted with the problem of maintaining the adjacent ends of the waistband in overlapping condition while attempting to locate the button in a position in which it may pass through a buttonhole. If the person is unable to use both hands, the buttoning operation is extremely difficult to complete.

A primary object of the invention is to provide an accessory which minimizes or overcomes the difficulty referred to above.

SUMMARY OF THE INVENTION

A buttoning accessory constructed in accordance with the invention is especially adapted for use in facilitating the passing of a button adjacent one end of the waistband of a pair of trousers through a buttonhole formed in the opposite end of the waistband so as to enable one-hand fastening of the opposite ends of the waistband. The waistband of a pair of trousers conventionally has at one end a button of predetermined thickness and diameter and the opposite end of the waistband has a buttonhole of such size as to enable the button to pass more or less freely therethrough.

The accessory includes a flexible handle which is of such thickness as to pass freely through the buttonhole and terminates at one end in a flat retainer body which is of such width and thickness as also to pass freely through the buttonhole. The body has two pairs of limbs which extend substantially parallel to one another and form an elbow. The limbs of each pair are spaced by a slot. The slot between the limbs adjacent the handle preferably is wider than the slot between the other limbs, but each slot has a width greater than the thickness of the button so as to enable the button to pass freely into and out of each slot.

The slot remote from the handle preferably is narrower than the other slot so as to minimize the inadvertent escape of a button from the slot, and the surface of the free edge of the body is smoothly rounded from the inside edge of the elbow to the outside edge thereof. The edge of the body at the inside of the elbow is beveled for the purpose of facilitating rotation of the retainer in the passage of the button through the buttonhole.

The width of the retainer body not only is such as to enable it to pass through the buttonhole, but it also is at least as great as the diameter of the button so that movement of the retainer body through the buttonhole carries with it the button, thereby minimizing the possibility that the position of the button could be skewed and create resistance to its passing through the buttonhole.

THE DRAWINGS

The presently preferred embodiment of the invention is disclosed in the following description and in the accompanying drawings, wherein.

THE PREFERRED EMBODIMENT

Figure 1:
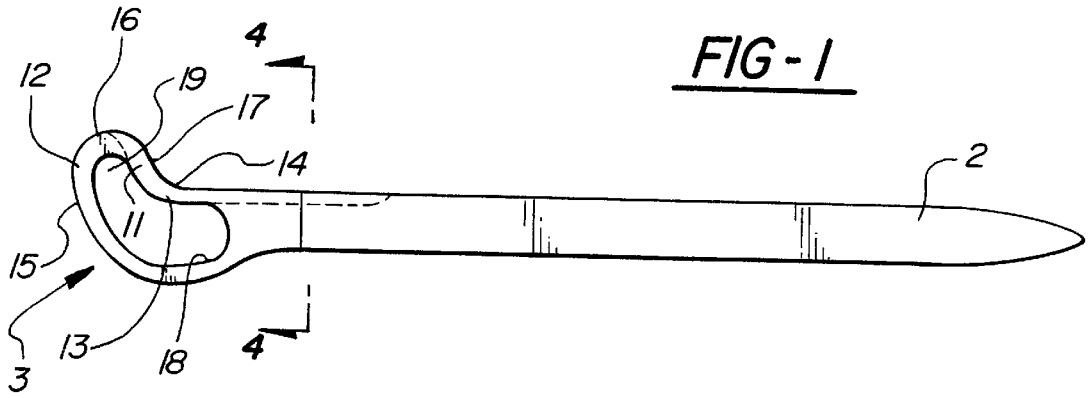
FIG. 1 is a plan view of a buttoning accessory constructed in accordance with the invention.

A buttoning accessory constructed in accordance with the presently preferred embodiment of the invention is designated generally by the reference character 1 and comprises an elongate, flexible handle 2 formed of leather, for example, and a flat, relatively stiff retainer 3 formed of plastic material that is stitched, stapled, or otherwise suitably secured at one end to the adjacent end of the handle 2. The accessory 1 is especially adapted for use in conjunction with the buttoning of the waistband of a pair of conventional trousers 4 having a waistband 5 at one end 6 of which is secured a button 7 of predetermined thickness and diameter. At the opposite end 8 of the waistband is a buttonhole 10 of such length and width as more or less freely to pass the button 7. The waistband 5 is of such length that the free end 8 may overlap the free end 6, as is conventional.

The accessory handle 2 is of such thickness that it freely may pass through the buttonhole 10 and the retainer 3 also is of such width and thickness that it may pass freely through the buttonhole.

The retainer 3 has two spaced apart pairs of limbs 11 and 12 which extend substantially parallel to one another so as to form an elbow 13 having an inside edge 14 and an outside edge 15. The edges 14 and 15 are joined by a smoothly rounded nose surface 16, and the inside of the elbow has a beveled edge 17.

The retainer 3 has two slots 18 and 19 therein, the two slots being in communication with each other. The slot 18 adjacent the handle end of the retainer preferably is wider than the slot 19, thereby facilitating movement of a button into and out of the slot 18.

Figure 2:
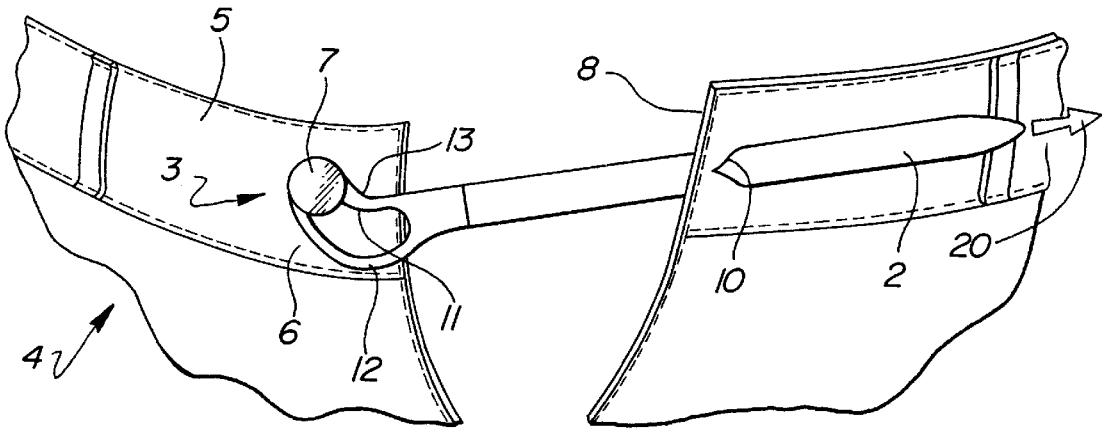
FIG. 2 is a fragmentary view illustrating the waistband of a pair of trousers and the buttoning accessory in an initial stage of conditioning the adjacent ends of the waistband for buttoning.
Figure 3:
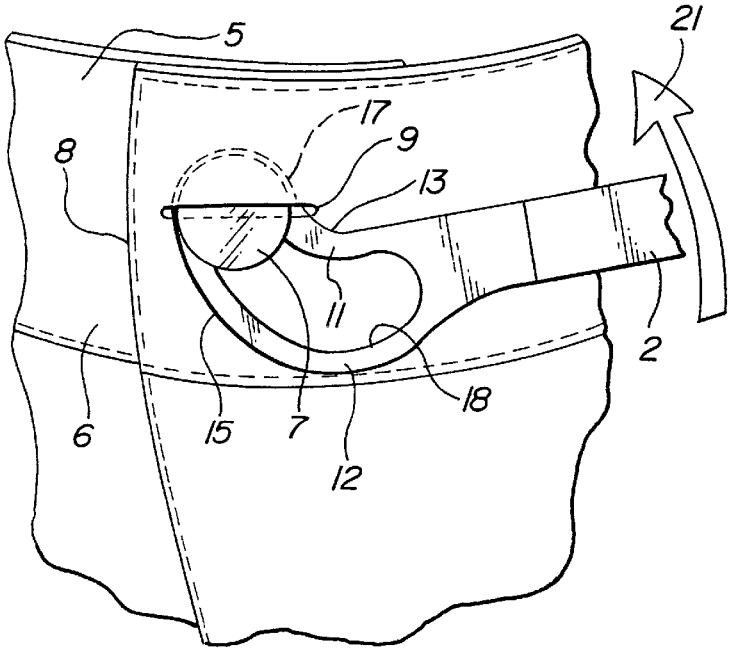
FIG. 3 is a fragmentary view similar to FIG. 2 but showing the accessory in an advanced condition of operation.
Figure 4:
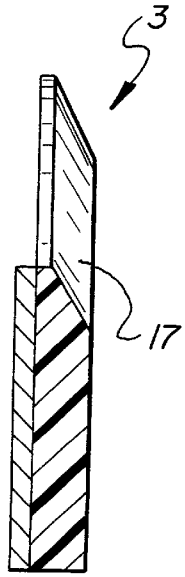
FIG. 4 is an enlarged sectional view taken on the line 4—4 of FIG. 1.

To condition the accessory for use the free end of the handle 2 is passed through the buttonhole 10 in a direction from the inside of the waistband 5 toward the outside thereof. The retainer 3 then may be placed in overlying relation to the opposite end 6 of the waistband and the button 7 passed through the larger slot 18 so that the retainer 3 underlies the button and bears upon the outer surface of the waistband end 6. A force then may be applied on the retainer 3 via the handle 2 and in the direction of the arrow 20 in FIG. 2 so as to draw the ends 6 and 8 of the waistband toward one another a distance sufficient to enable the waistband end 8 to overlie the end 6, as is shown in FIG. 3. In these positions of the parts the threads anchoring the button 7 to the waistband 5 will bear against the remote end of the slot 19 and the button 7 will underlie the buttonhole 10. When the parts are in this position, movement of the handle 2 in the direction of the arrow 21 in FIG. 3 will cause the beveled edge 17 of the body 3 to rotate relative to the waistband end 8 and, since the edge 17 lies atop the waistband end 8, such rotation will cause the nose 16 of the body 3 to move to a position in which the body 3 overlies the waistband end 6. Since the button is trapped in the slot 19, the button also will pass through the buttonhole to a position in which it, too, overlies waistband end 8. This movement of the body and button through the buttonhole 10 is facilitated by the beveled edge 17 at the inside of the elbow. The manner in which the button is caused to pass through the buttonhole is similar to that in which the rim of an automobile wheel is passed through the central opening of a tire.

Since the button does not extend beyond the opposite sides of the limbs 11 and 12 of the retainer 3, the peripheral edge of the button must move along the same path as that taken by the retainer 3. Accordingly, the position of the button relative to the retainer 3 cannot become skewed so as to impede its passage through the buttonhole 10.

Once the button has passed through the buttonhole 10 it will overlie the end 8 of the waistband and secure the overlapping ends of the waistband to one another. The handle 2 than may be manipulated to free the button from the slots 18 and 19.

The disclosed embodiment is representative of a presently preferred form of the invention, but is intended to be illustrative rather than definitive thereof. The invention is defined in the claims.

I claim:

1. A buttoning accessory for use in passing a button of predetermined diameter and thickness and secured to one part of a garment through a buttonhole formed in another part of said garment, said accessory comprising:

a) a retainer having opposite ends and being of such width and thickness as to pass through said buttonhole, b) a handle secured at one end of said retainer and being of such width and thickness as to pass freely through said buttonhole, c) said retainer having therein a slot closed at that end remote from said handle, d) said slot having a width less than the diameter of said button but sufficient to enable said button to pass freely through said slot to a position in which said button wholly overlies said retainer, e) said retainer having a width at said remote end of said slot no less than the diameter of said button; and f) said retainer having two angularly extending limbs together forming between the opposite ends of said retainer an elbow having an inside edge and an outside edge.

2. The accessory according to claim 1 wherein the width of said retainer corresponds substantially to the diameter of said button.

3. The accessory according to claim 1 wherein the width of said retainer is greater than the diameter of said button.

4. The accessory according to claim 1 wherein said handle is relatively flexible and said retainer is relatively stiff.

5. The accessory according to claim 1 wherein said slot has two angularly offset leg portions.

6. The accessory according to claim 5 wherein said leg portions have different widths.

7. The accessory according to claim 1 wherein said retainer has a beveled surface at the inside edge of said elbow.

8. The accessory according to claim 1 wherein said retainer has a smoothly rounded surface joining both edges of said elbow.

9. The accessory according to claim 1 wherein said limbs of said retainer are substantially parallel to one another.

10. A buttoning accessory for use in passing through a buttonhole a button of predetermined thickness and diameter, said buttonhole being of such length as to enable said button freely to pass through said buttonhole, said accessory comprising:

a) a flat retainer formed of relatively rigid material and of such width and thickness as to pass freely through said buttonhole, the width of said retainer being at least as great as the diameter of said button, b) a handle formed of relatively flexible material secured to one end of said retainer and being of such thickness as to pass freely through said buttonhole, c) said retainer having first and second limbs extending angularly from one another and forming an elbow having an inside edge and an outside edge, d) the first one of said limbs having a first slot therein, e) the second one of said limbs having a second slot therein, f) said first slot and said second slot being in communication with one another; and g) each said first slot and said second slot having a width at least as great as the thickness of said button and less than the diameter of said button.

11. The accessory according to claim 10 wherein said retainer has a smoothly rounded surface joining the inside edge of said elbow and the outside edge of said elbow.

12. The accessory according to claim 10 wherein said retainer has a beveled surface at the inside edge of said elbow.

13. The accessory according to claim 10 wherein said first slot and said second slot have different widths.

14. The accessory according to claim 13 wherein the slot of less width is remote from said one end of said retainer.

15. The accessory according to claim 10 wherein the width of that limb of said retainer which is remote from said one end of said retainer is greater than the diameter of said button.

* * * * *